US011358214B2

(12) United States Patent
Takahashi

(10) Patent No.: US 11,358,214 B2
(45) Date of Patent: Jun. 14, 2022

(54) CONDUCTIVE MOLTEN METAL CONVEYANCE APPARATUS, CONDUCTIVE MOLTEN METAL CONVEYANCE SYSTEM, AND CONDUCTIVE MOLTEN METAL CONVEYANCE METHOD

(71) Applicant: Kenzo Takahashi, Shiroi (JP)

(72) Inventor: Kenzo Takahashi, Shiroi (JP)

( * ) Notice: Subject to any disclaimer, the term of this patent is extended or adjusted under 35 U.S.C. 154(b) by 0 days.

(21) Appl. No.: 17/083,456

(22) Filed: Oct. 29, 2020

(65) Prior Publication Data

US 2021/0039160 A1 Feb. 11, 2021

Related U.S. Application Data

(63) Continuation of application No. PCT/JP2019/017463, filed on Apr. 24, 2019.

(30) Foreign Application Priority Data

May 2, 2018 (JP) ..... JP2018-088830

(51) Int. Cl.
*B22D 11/115* (2006.01)
*B22D 27/02* (2006.01)

(52) U.S. Cl.
CPC ..... *B22D 11/115* (2013.01); *B22D 27/02* (2013.01)

(58) Field of Classification Search
CPC ..... B22D 11/115; B22D 27/02; B22D 35/00; B22D 37/00
USPC ..... 164/498, 500, 147.1, 437, 488; 75/10.67
See application file for complete search history.

(56) References Cited

U.S. PATENT DOCUMENTS 4,444,378 A * 4/1984 Reese ..... C21C 5/5211 222/594
5,398,750 A * 3/1995 Crepeau et al. ..... B22D 37/00 164/154.2

FOREIGN PATENT DOCUMENTS

| | | | |
|---|---|---|---|
| JP | 49-030613 | B1 | 8/1974 |
| JP | 08-332563 | A | 12/1996 |
| JP | 2007-021539 | A | 2/2007 |
| JP | 4772407 | B2 | 9/2011 |
| WO | WO 2007/026857 | A1 | 3/2007 |

OTHER PUBLICATIONS

International Search Report dated Jul. 16, 2019 in PCT/JP2019/017463 filed on April 24, 2019, 1page.

(Continued)

*Primary Examiner* — Kevin P Kerns
(74) *Attorney, Agent, or Firm* — Oblon, McClelland, Maier & Neustadt, L.L.P.

(57) ABSTRACT

By setting an electric resistance of a trough to a value larger than an electric resistance of a molten metal stored in a storage space, in a non-driving state, a current is caused to flow along a first current path from one side wall of the pair of side walls to another side wall through the bottom wall, and in a driving state, a current is caused to flow through a second current path from the one side wall through a middle part of the first current path and bypass to the molten metal, and return to the first current path, and in the driving state, in the molten metal, causing the magnetic force lines running vertically and the current running horizontally to cross each other to generate a Lorentz force, and by the Lorentz force, driving and carrying the molten metal in the trough.

12 Claims, 4 Drawing Sheets

(56) References Cited

OTHER PUBLICATIONS

Japanese Office Action dated Oct. 18, 2019 in Japanese application 2019-541461, 5 pages (with English Machine Translation).
International Preliminary Report on Patentability and Written Opinion dated Nov. 12, 2020 in PCT/JP2019/017463 (submitting English translation only), 6 pages.

* cited by examiner

CONDUCTIVE MOLTEN METAL CONVEYANCE APPARATUS, CONDUCTIVE MOLTEN METAL CONVEYANCE SYSTEM, AND CONDUCTIVE MOLTEN METAL CONVEYANCE METHOD

TECHNICAL FIELD

The present invention relates to a conductive molten metal conveyance apparatus, a conductive molten metal conveyance system, and a conductive molten metal conveyance method.

BACKGROUND ART

Conventionally, there is performed manufacturing of, for example, a cast product (a round bar-shaped ingot or the like) with a molten metal having conductivity (conducting property), that is, a molten metal of non-ferrous metal (for example, Al, Cu, Zn or Si, or an alloy of at least two of them, or an Mg alloy, or the like) or a molten metal of other than non-ferrous metal.

In obtaining this cast product, it is common practice to guide the molten metal from a melting furnace with a trough and pour the molten metal into a mold.

Moreover, the present inventor has disclosed in Patent Literature 1 that a molten metal flowing in a trough is driven and conveyed by Lorentz force according to Fleming's left-hand rule.

CITATION LIST

Patent Literature

Patent Literature 1: Japanese Patent No. 4772407

SUMMARY OF INVENTION

Technical Problem

According to the technique disclosed in Patent Literature 1, by driving the molten metal in the trough by Lorentz force, it is possible to more reliably drive and convey the molten metal without relying only on gravity.

However, when the amount of the molten metal in the trough decreases and the liquid level drops below the positions of electrodes, the Lorentz force can no longer be obtained, and as a matter of course, the molten metal cannot be driven.

To prevent this, for example, the following measure may be taken. That is, it is just necessary to lower the positions of the electrodes, or to form the electrodes in plate shapes so that lower ends of the electrodes reach an inner surface of a bottom wall of the trough.

However, in any of the above cases, it is difficult to completely drive and convey the molten metal in the trough by the Lorentz force to completely discharge the molten metal from the trough even in a final stage of a work. That is, as the molten metal, normally, it can happen that numerous drop-shape or island-shape molten metals remain here and there on a bottom wall 5*c* of the trough 5, for example, as illustrated in FIG. 5 described later due to attributes thereof. Thus, the remaining molten metal cannot be driven and conveyed by the Lorentz force.

For this reason, at a site in practice, many workers manually scrape the molten metal from the trough before the molten metal is solidified just before the end of conveyance.

Such an operation is extremely dangerous because the molten metal has a high temperature and it must be performed in a short time. However, such an operation is an indispensable work, not limited to the case of Patent Literature 1, when the molten metal is conveyed using the trough.

The present invention has been made in view of the above, and an object thereof is to provide a conductive molten metal conveyance apparatus, a conductive molten metal conveyance system, and a conductive molten metal conveyance method capable of driving and conveying a molten metal so that the molten metal does not remain in the trough as much as possible when the trough is used for conveyance.

Solution to Problem

A conductive molten metal conveyance apparatus according to an embodiment of the present invention is a conductive molten metal conveyance apparatus that drives a target conductive molten metal that is a drive target by Lorentz force, the apparatus including:

a trough that has at least a molten metal storage space defined by a pair of side walls laterally facing each other at a predetermined distance and a bottom wall connecting the side walls, and is formed by a fire resistant and conductive material; and a magnetic field device that is arranged below the bottom wall of the trough, and has an upper surface side that vertically opposes the bottom wall and is magnetized to a north pole or a south pole, in which magnetic field strength is set to strength such that magnetic force lines exiting from the magnetic field device or entering the magnetic field device run vertically in the molten metal storage space and the target conductive molten metal stored in the molten metal storage space in a state of penetrating the bottom wall, in which by setting an electric resistance value of the trough to a value larger than an electric resistance value of the target conductive molten metal stored in the molten metal storage space, in a non-driving state where the target conductive molten metal is not present in the molten metal storage space, a current flows through a first current path from one side wall of the pair of side walls to another side wall through the bottom wall, and in a driving state where the target conductive molten metal is present in the molten metal storage space, a current flows through a second current path from the one side wall through a middle part of the first current path and bypasses to the target conductive molten metal, and thereafter returns to the first current path again, and in the driving state, in the target conductive molten metal, magnetic force lines running vertically and the current running horizontally cross each other to generate a Lorentz force, and the Lorentz force drives and carries the target conductive molten metal in the trough.

A conductive molten metal conveyance system according to an embodiment of the present invention includes a plurality of the conductive molten metal conveyance apparatuses described above, in which the plurality of conductive metal conveyance apparatuses are connected in series so that it is possible to supply a target conductive molten metal conveyed by the conductive molten metal conveyance apparatus in a preceding stage to the molten metal storage space of the conductive molten metal conveyance apparatus in a next stage.

A conductive molten metal conveyance method according to the present invention is a conductive molten metal conveyance method that drives a target conductive molten metal that is a drive target by Lorentz force, the method including:

preparing a trough that has at least a molten metal storage space defined by a pair of side walls laterally facing each other at a predetermined distance and a bottom wall connecting the side walls, and is formed by a fire resistant and conductive material;

arranging a magnetic field device below the bottom wall of the trough, the magnetic field device having an upper surface side that vertically opposes the bottom wall and is magnetized to a north pole or a south pole, in which magnetic force lines exiting from the magnetic field device or entering the magnetic field device run vertically in the molten metal storage space and the target conductive molten metal stored in the molten metal storage space in a state of penetrating the bottom wall; and by setting an electric resistance value of the trough to a value larger than an electric resistance value of the target conductive molten metal stored in the molten metal storage space, in a non-driving state where the target conductive molten metal is not present in the molten metal storage space, causing a current to flow along a first current path from one side wall of the pair of side walls to another side wall through the bottom wall, and in a driving state where the target conductive molten metal is present in the molten metal storage space, causing a current to flow through a second current path from the one side wall through a middle part of the first current path and bypass to the target conductive molten metal, and thereafter return to the first current path again, and in the driving state, in the target conductive molten metal, causing the magnetic force lines running vertically and the current running horizontally to cross each other to generate a Lorentz force, and by the Lorentz force, driving and carrying the target conductive molten metal in the trough.

DESCRIPTION OF EMBODIMENTS

One of characteristics of an embodiment according to the present invention is that an entire trough is formed by a conductive material, as will be described later. However, this is a configuration that cannot be employed by those skilled in the art other than the present inventor even if the above-mentioned Patent Literature 1 is publicly known. The reason is that in order to obtain the Lorentz force for driving molten metal in the trough, it is necessary to pass a current across a pair of electrodes opposing each other through the molten metal interposed between the electrodes. However, if the entire trough is formed by a conductive material, it is intuitively sensed that the current flows through only the trough and it is impossible to take a path of current to flow from one electrode into the molten metal and return again to the other electrode.

Figure 4:
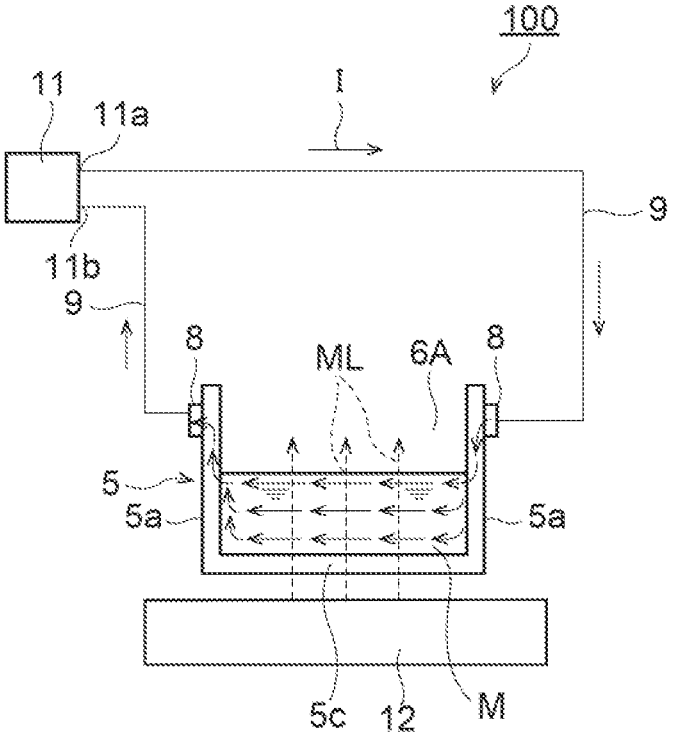
FIG. 4 is an explanatory view illustrating a current flow in a driving state in the conductive molten metal conveyance system of FIG. 1.

Moreover, the present inventor actually conducted an experiment for confirming whether or not the current really takes a path as illustrated in FIG. 4 described later. From a result of the experiment, it was technically understood that the current path becomes as illustrated in FIG. 4. The present invention has been uniquely made by the present inventor based on the result of this experiment. In other words, the present invention can be said as an invention that cannot be made by a person skilled in the art who would not carry out such an experiment.

Figure 1:
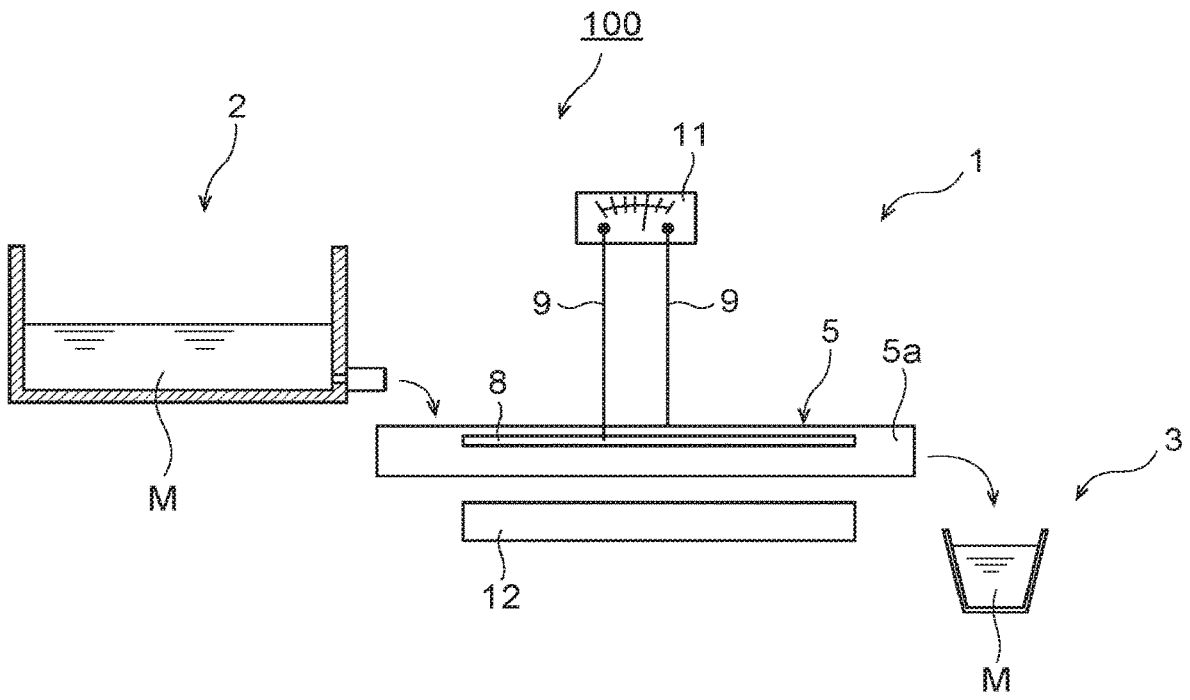
FIG. 1 is an explanatory side view illustrating an overall configuration of a conductive molten metal conveyance system using a conductive molten metal conveyance apparatus as a first embodiment of the present invention.

FIG. 1 is an explanatory side view illustrating an overall configuration of a conductive molten metal conveyance system 100 using a conductive molten metal conveyance apparatus 1 according to a first embodiment of the present invention. Note that in the following description, the "conductive molten metal conveyance apparatus" is abbreviated as "molten metal conveyance apparatus" or "molten metal conveyance apparatus".

FIG. 1 illustrates a case where the molten metal M is conveyed in a lateral direction in the view by the conductive molten metal conveyance apparatus 1.

That is, by this molten metal conveyance apparatus 1, the molten metal M having conductivity (conducting property) poured from the melting furnace 2, that is, a molten metal of non-ferrous metal (for example, Al, Cu, Zn or Si, or an alloy of at least two of them, or an Mg alloy, or the like) or a molten metal of other than non-ferrous metal is conveyed from left to right in the view and stored in a container 3.

Figure 2:
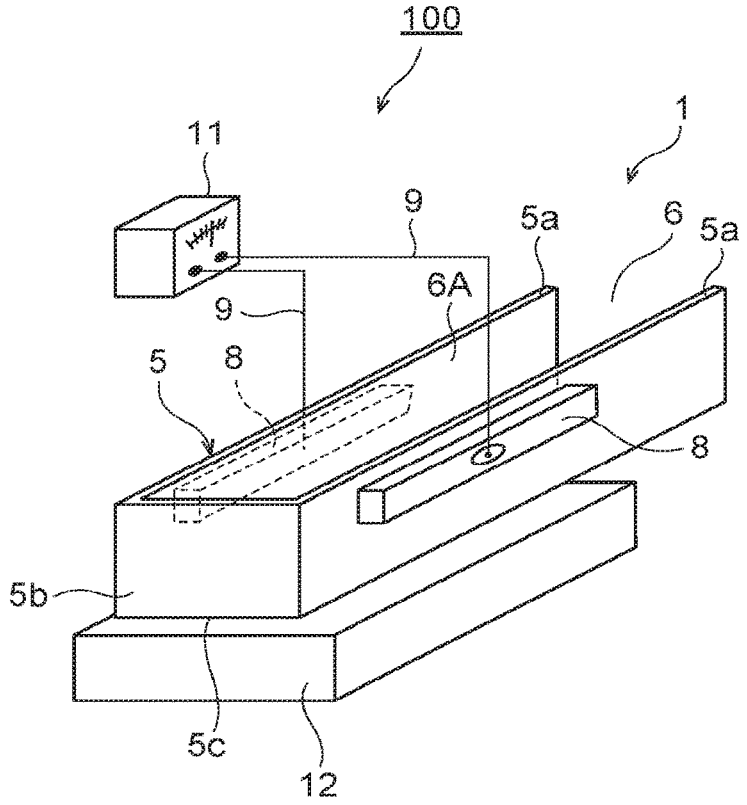
FIG. 2 is an explanatory perspective view of the conductive molten metal conveyance apparatus in FIG. 1.

Details of the molten metal conveyance apparatus 1 are illustrated in a more understandable manner in FIG. 2, which is a perspective view. The molten metal conveyance apparatus 1 has a trough 5. The trough 5 is formed by a material having conductivity. Specifically, it is formed by a self-heating type conductive material such as pure carbon, which self-heats when energized and has fire resistance. As the conductive material forming the trough 5, a material having an electric resistance value larger than the electric resistance value of the molten metal M to be poured therein is used. Moreover, this trough 5 is configured as a channel steel type, and a base end side thereof is closed (when connecting a plurality of troughs, the base end side may be open), and a distal end side is open. That is, this trough 5 has a pair of side walls 5*a* facing each other in a width direction, an end wall 5*b* closing the base end side, and a bottom wall 5*c*, and the distal end side becomes an opening 6 as an open spout. That is, the trough 5 has a molten metal storage space 6A defined by the pair of side walls 5*a* facing each other in a lateral direction at a predetermined distance and the bottom wall 5*c* connecting the side walls 5*a*.

Long bump-shaped terminals (electrodes) 8 are attached respectively outside the pair of side walls 5*a*.

The terminals 8 are formed by a high-conductivity material such as copper, and is for enhancing electrical conductivity between the trough 5 and cables 9. That is, the terminals 8 are connected to a power control panel 11 installed outside by the cables 9. This power control panel 11 supplies a current to the pair of terminals 8, and is configured so that a current value, a voltage value, and a frequency thereof can be adjusted and a polarity can be switched. This power control panel 11 is basically used as a direct current supply device in the embodiment of the present invention.

A magnetic field device 12 is arranged below the trough 5. The magnetic field device 12 includes a permanent magnet or an electromagnet. The magnetic field device 12 is magnetized to an N pole at an upper side and an S pole at a lower side. Thus, for example, as can be seen from FIG. 4 described later, magnetic force lines ML extend upward from below and run vertically through the molten metal M in the trough 5 through the bottom wall 5*c* of the trough 5. Thus, when a current I flows laterally in the molten metal M, the magnetic force lines ML and the current I cross each other to generate a Lorentz force F according to Fleming's left-hand rule. Note that, conversely to the above, the upper part may be magnetized to the S pole and the lower part may be magnetized to the N pole. At this time, the current I flows in the opposite direction to the above.

Next, the flow of current in the conductive molten metal conveyance system 100 configured as described above will be described.

Figure 3:
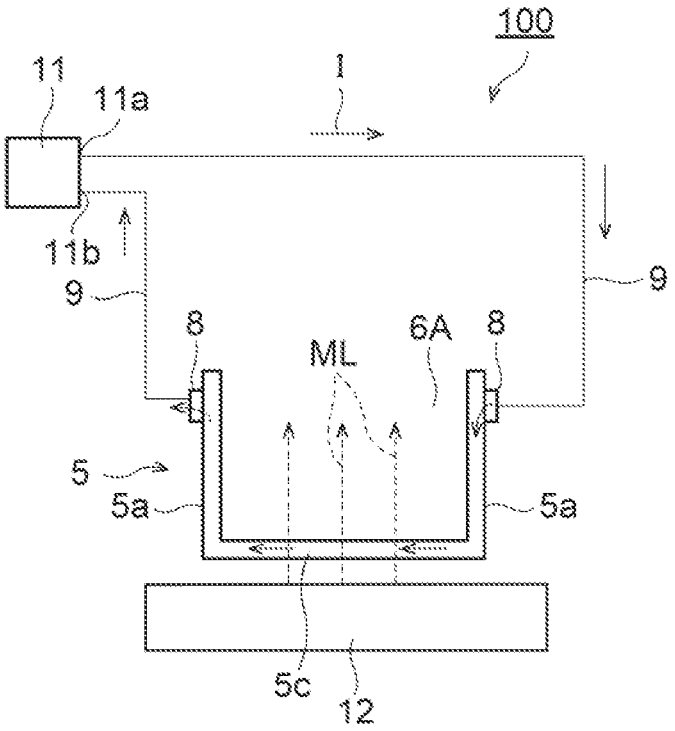
FIG. 3 is an explanatory view illustrating a current flow in a non-driving state in the conductive molten metal conveyance system of FIG. 1.

First, in a state that the molten metal M does not exist in the trough 5 (non-driving state), as illustrated in FIG. 3, the current I flows out of a power terminal 11*a* of the power control panel 11, passes through the cable 9, the terminal 8, and the trough 5 (side wall 5*a*, bottom wall 5*c*, side wall 5*a*), the terminal 8, and the cable 9 and returns to a power terminal 11*b* of the power control panel 11 (first flow path). By the flow of the current I, the trough 5 self-heats due to Joule heat and becomes a high temperature state, and the high temperature state is maintained by continuing energization. Thus, a residual heat state is maintained.

In a state that the molten metal M is poured from the melting furnace 2 into the trough 5 (driving state), the current I flows as illustrated in FIG. 4. That is, in particular, the current I flowing from the terminal 8 to the one side wall 5*a* flows into the molten metal M from a middle part of the side wall 5*a* because the electric resistance value of the molten metal M is smaller than the electric resistance value of the side wall 5*a*, passes through the molten metal M to reach the other side wall 5*a*, and returns to the power control panel 11 via the terminal 8 and the cable 9 (second flow path). As can be seen from FIGS. 4 and 3, the beginning and the end of the second flow path are the same flow path as the first flow path. That is, in the driving state, the current flows through a second current path from the one side wall 5*a* through a middle part of a first current path and bypasses to the target conductive molten metal, and thereafter returns again to the other side wall 5*a* in the first current path.

Even when the current I flows as illustrated in FIG. 4, since the current I passes through a part of the pair of side walls 5*a*, the side walls 5*a* self-heat due to Joule heat, and the trough 5 is kept in a high temperature state. Thus, the molten metal M in the trough 5 is heated even without heating the trough 5 by an external nichrome wire, a burner, or the like, and is kept in a liquid state and continuously circulated.

Figure 5:
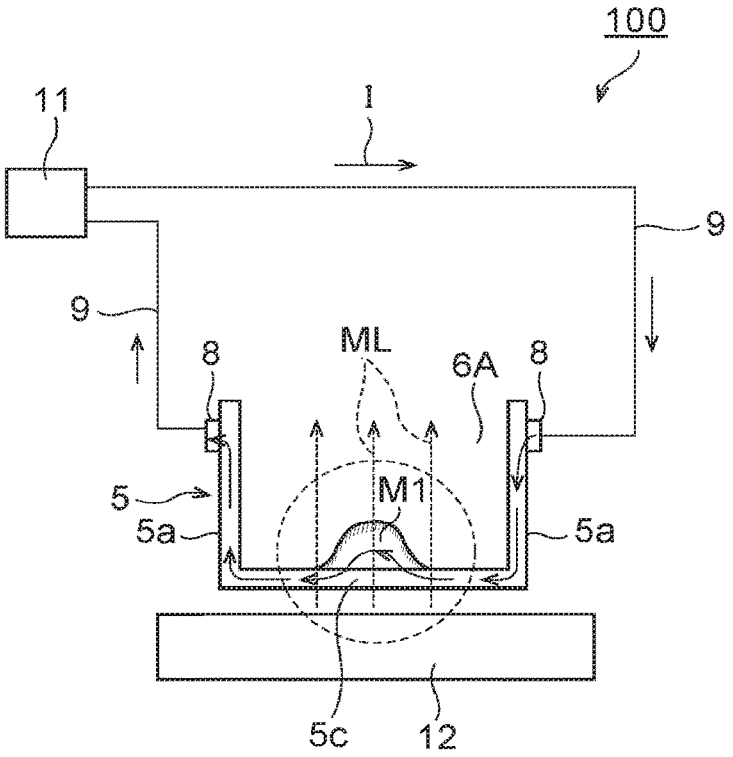
FIG. 5 is an explanatory view illustrating a current flow when the molten metal remains in drop shape in the conductive molten metal conveyance system of FIG. 1.
Figure 6:
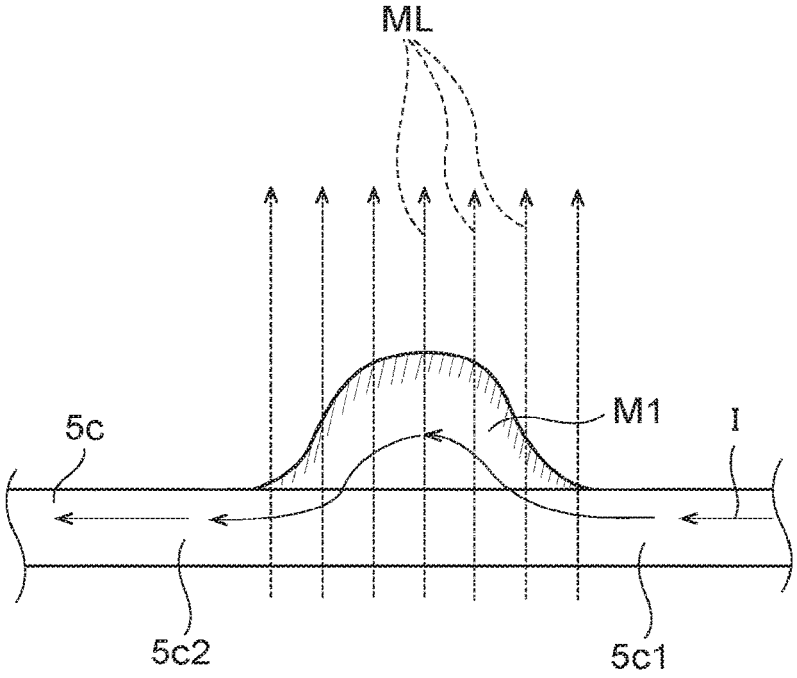
FIG. 6 is a partially enlarged explanatory view of FIG. 5.

FIG. 5 illustrates a flow of the current I particularly when the molten metal M from the melting furnace 2 is almost completely conveyed and remains on the trough 5 as a little drop-shape or island-shape molten metal M1. That is, when the molten metal M1 slightly remains on the bottom wall 5*c*, as illustrated in FIG. 5, as can be seen particularly from FIG. 6 which is a partially enlarged view of FIG. 5, the current I from the bottom wall 5*c* (in a right side portion 5*c*1) bypasses the bottom wall 5*c* below the molten metal M1, flows into the molten metal M1, and then returns to the bottom wall 5*c* (in a left side portion 5*c*2) again. In other words, even when the molten metal M remains on the bottom wall 5*c* of the trough 5 as a small amount of drop-shape or island-shape molten metal M1, the current I reliably flows through the molten metal M because the trough 5 is formed by a conductive material. Thus, as will be described later, even when only a small amount of the molten metal M1 remains on the bottom wall 5*c*, the molten metal M1 can be conveyed and discharged to the outside from an upper surface of the bottom wall 5*c* of the trough 5 by the Lorentz force according to Fleming's left-hand rule. This is confirmed by an experiment conducted by the present inventor, which will be described later.

That is, as will be described later, according to the apparatus of the embodiment of the present invention, the current I can be reliably passed through the molten metal M regardless of the amount of the molten metal M. Thus, the current I and the magnetic force lines ML can be reliably crossed, and the molten metal M can be reliably conveyed by the Lorentz force according to Fleming's left-hand rule and discharged from the trough.

This point will be described below. That is, the driving of the molten metal M in the trough 5 by the Lorentz force F according to Fleming's left-hand rule due to the above-described crossing of the flow of the current I and the magnetic force lines ML from the magnetic field device 12 will be described in detail.

First, in FIG. 4, the current I and the magnetic force lines ML from the magnetic field device 12 cross each other as illustrated in the view. Thus, a Lorentz force F is generated according to Fleming's left-hand rule, and the molten metal M is driven and conveyed from the base end side to the distal end side of the trough 5. Consequently, the molten metal M is reliably poured into the container 3 in FIG. 1.

Further, also in FIG. 5, as in a case of FIG. 4, the remaining molten metal M1 is poured into the container 3 of FIG. 1. That is, even when the amount of the molten metal M becomes extremely small as in a state particularly when the molten metal M has finished flowing, the current I reliably flows through the molten metal M, so that the Lorentz force can be reliably obtained and all the molten metal M can be reliably driven and conveyed to the distal end side of the trough 5, and the molten metal M can be prevented from remaining in the trough 5.

In the first embodiment, the case where the molten metal M is conveyed in the horizontal direction has been described. According to a second embodiment of the present invention described next, as can be seen from FIG. 7, the molten metal M can be conveyed so as to be lifted obliquely upward against the gravity. That is, even when the trough 5 is installed in what is called a sloped state by lifting the distal end side of the trough 5 from the base end side in FIG. 1, the molten metal M can be conveyed so as to ascend the sloped trough 5.

Figure 7:
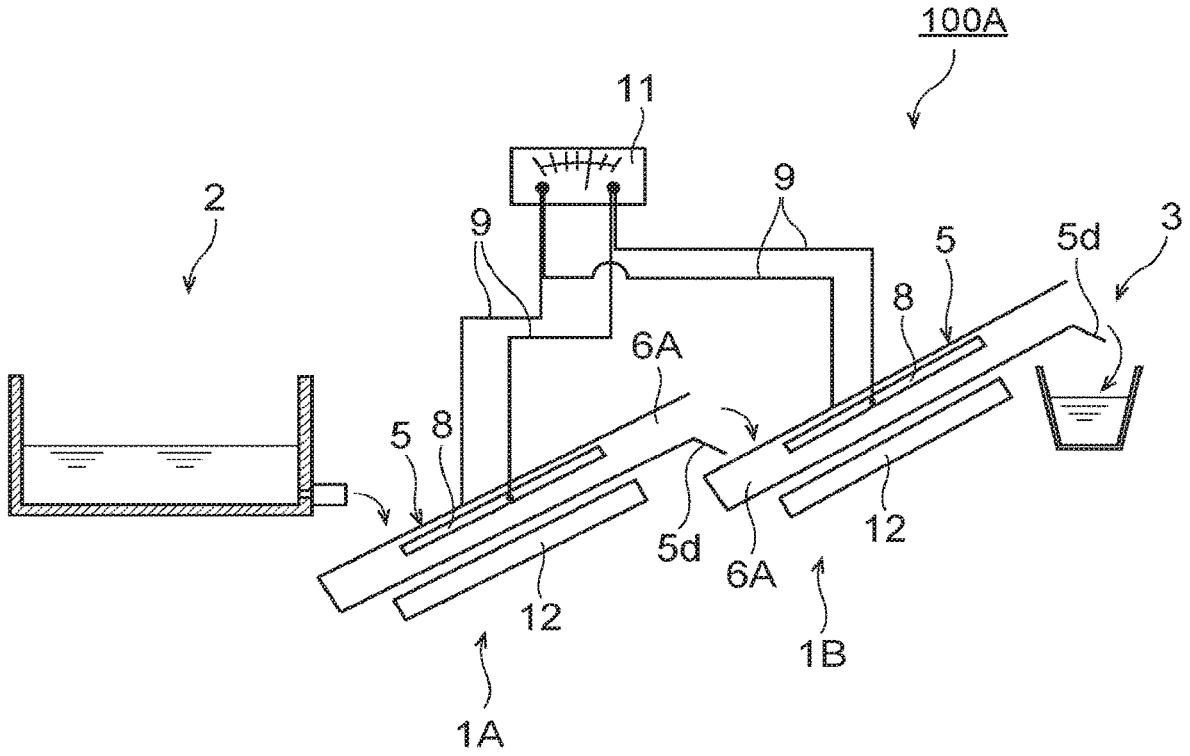
FIG. 7 is an explanatory side view illustrating an overall configuration of a conductive molten metal conveyance system using a plurality of conductive molten metal conveyance apparatuses as a second embodiment of the present invention.

That is, FIG. 7 is a side explanatory view of a conductive molten metal conveyance system 100A according to the second embodiment of the present invention. This second embodiment describes what is called a tandem type apparatus installed in a sloped state, in which two molten metal conveyance apparatuses 1 illustrated in FIG. 2 (that is, a molten metal conveyance apparatus 1A and a molten metal conveyance apparatus 1B) are used in series in cooperation with each other, and each trough is lifted at the distal end side. That is, the molten metal M from the melting furnace 2 is conveyed one stage upward by the molten metal conveyance apparatus 1A and sent to the molten metal conveyance apparatus 1B, conveyed one stage further upward in the molten metal conveyance apparatus 1B, and stored in the container 3 which is located at a position that is higher by two stages in total than the melting furnace 2. Note that the number of molten metal conveyance apparatuses 1 that are in cooperation in series can be three or more. Thus, the conveyance distance in the horizontal direction can be extended, and the conveyance height can be made higher.

Note that although the molten metal conveyance apparatuses 1A, 1B used in FIG. 7 are substantially the same as the molten metal conveyance apparatus 1 of FIG. 2, the molten metal conveyance apparatuses 1A, 1B differ from the molten metal conveyance apparatus 1 only in that a guide plate 5*d* to guide downward flow of the molten metal M is formed on the bottom wall 5*c* at the distal end side of the trough 5.

Note that in the embodiment illustrated in FIG. 7, both of the molten metal conveyance apparatuses 1A, 1B are provided with a gradient, but one with a gradient and one without a gradient can be arbitrarily combined. Of course, it is also possible to connect any number of horizontal molten metal conveyance apparatuses in series.

Further, in any of the above-described embodiments, the molten metal M can be driven in a more suitable state by appropriately adjusting the current value, the voltage value, and the polarity by operating the power control panel 11.

Further, by passing a low-cycle alternating current (at 1 to 5 Hz or the like) from the power control panel 11, the molten metal M can be vibrated back and forth at low cycles along the conveyance direction. This vibration accelerates the rate at which gas mixed in the molten metal rises in the molten metal and facilitates the escape of the gas from the molten metal, and quality of the molten metal can be improved. Further, the molten metal may be vibrated back and forth in the conveyance direction as described above at any time before driving and conveying the molten metal or during driving and conveying the molten metal. This makes it possible to carry out more smoothly and reliably the driving and conveyance of the molten metal forward, and to achieve high efficiency of the molten metal conveyance.

Experimental Example

The present inventor conducted the following experiment in order to confirm the operation and effect of the conductive molten metal conveyance apparatus of the present invention.

That is, the present inventor conducted an experiment under the following conditions using what is called a low melting point alloy having the same characteristics as a molten metal such as aluminum.

| | |
|---|---|
| Length of trough | 1000 mm |
| Inner dimension (width of trough groove) | 90 mm |
| Height | 50 mm |
| Tilt | +5 degrees |
| Magnetic field strength | 1500 G |
| Specific gravity of molten metal (low melting alloy) | Approximately 10 |
| Temperature | approximately 100° C. |
| Current | 500 A |

At this time, 150 Kg/min (=9000 Kg/h) was obtained as the conveyance amount in the experiment.

At the end of conveyance, the inside of the trough was confirmed, but no molten metal remaining in the groove of the trough 5 was observed. In other words, the molten metal ascended the sloped trough 5 to the last drop and was discharged from the outlet.

The following effects can be obtained by the conductive molten metal conveyance apparatus according to the embodiments of the present invention described above.

1. It is possible to prevent damage to the apparatus due to thermal shock. That is, as illustrated in FIG. 3, if the empty trough 5 is energized in advance, it is possible to preheat without the need for external heating means, so that when the molten metal M is poured into the trough 5, it is possible to prevent the trough 5 from being damaged by the heat of the molten metal.

2. No special and complicated operation is required to preheat the trough. That is, it is sufficient to simply energize the trough 5 for residual heat.

3. By connecting a plurality of molten metal conveyance apparatuses in series, it is possible to convey the molten metal over a longer distance.

4. It became possible to prevent a temperature drop of the molten metal during conveyance as much as possible. Just by energizing the trough 5 to drive the molten metal M, the trough 5 self-heats automatically. For this reason, when the molten metal M flows in the trough 5, the molten metal M runs in the heated trough 5, and it is possible to prevent the temperature of the molten metal M from decreasing during conveyance, and to reliably convey the molten metal.

5. The amount of molten metal remaining in the trough at the end of conveyance can be substantially eliminated, and the amount of molten metal M in the trough 5 can be reduced to the limit.

6. Since the molten metal M remaining in the trough 5 after use can be substantially eliminated, cleaning of the trough is substantially unnecessary.

7. The conveyance amount of the molten metal can be arbitrarily adjusted by controlling the current I in the power control panel 11.

8. Since the electrodes 8 are provided outside the pair of side walls 5*a* of the trough 5, the electrodes 8 do not come in contact with the molten metal M. Therefore, wear of the electrodes 8 can be suppressed as much as possible, and there is no need to replace the electrode.

Based on the above description, those skilled in the art may conceive additional effects and various modifications of the present invention, but the aspects of the present invention are not limited to the individual embodiments described above. Components may be suitably combined across different embodiments. Various additions, changes and partial deletions are possible without departing from the conceptual idea and spirit of the present invention derived from the contents defined in the claims and the equivalents thereof.

REFERENCE SIGNS LIST

1 conductive molten metal conveyance apparatus
1A, 1B molten metal conveyance apparatus
2 melting furnace
3 container
5 trough
5*a* side wall
5*b* end wall
5*c* bottom wall
5*c*1 right side portion
5*c*2 left side portion
5*d* guide plate
6 opening
6A molten metal storage space

8 terminal (electrode)
9 cable
11 power control panel
11*a* power terminal
11*b* power terminal
12 magnetic field device
100, 100A conductive molten metal conveyance system
F Lorentz force
I current
M molten metal
M1 molten metal
ML magnetic force line

The invention claimed is:

1. A conductive molten metal conveyance apparatus that drives a target conductive molten metal that is a drive target by Lorentz force, the apparatus comprising:

a trough that has at least a molten metal storage space defined by a pair of side walls laterally facing each other at a predetermined distance and a bottom wall connecting the side walls, and is formed by a lire resistant and conductive material, wherein an electric resistance value of the trough is a value larger than an electric resistance value of the target conductive molten metal stored in the molten metal storane space;

a magnetic field device that is arranged below the bottom wall of the trough, and has a permanent magnet, wherein an upper surface side of the permanent magnet vertically opposes the bottom wall and is magnetized to a north pole or a south pole, in which magnetic field strength is set to strength such that magnetic force lines exiting from the magnetic field device or entering the magnetic field device run vertically in the molten metal storage space and the target conductive molten metal stored in the molten metal storage space in a state of penetrating the bottom wall; and electrodes that are provided respectively outside the pair of side walls of the trough, wherein the electrodes are electrically connected to a power supply device.

2. The conductive molten metal conveyance apparatus according to claim 1, wherein the power supply device is capable of supplying at least a direct current, wherein the power supply device and the electrodes are connected by a cable.

3. The conductive molten metal conveyance apparatus according to claim 2, wherein the power supply device is also configured to be capable of supplying a low-cycle alternating current at 1 to 5 Hz.

4. The conductive molten metal conveyance apparatus according to claim 1, wherein electric resistance values of the electrodes are smaller than the electric resistance value of the trough.

5. The conductive molten metal conveyance apparatus according to claim 1, wherein the electrode is formed as an elongated electrode in a length direction of the trough.

6. The conductive molten metal conveyance apparatus according to claim 1, wherein the trough is installed horizontally.

7. The conductive molten metal conveyance apparatus according to claim 1, wherein the trough is installed so as to have a slope in which a distal end side is raised more than a base end side.

8. A conductive molten metal conveyance system comprising a plurality of the conductive molten metal conveyance apparatuses according to claim wherein the plurality of conductive metal conveyance apparatuses are connected in series so that it is possible to supply a target conductive molten metal conveyed by the conductive molten metal conveyance apparatus in a preceding stage to the molten metal storage space of the conductive molten metal conveyance apparatus in a next stage..

9. The conductive molten metal conveyance system according to claim 8, wherein the conductive molten metal conveyance apparatuses are arranged so that the respective troughs are horizontal.

10. The conductive molten metal conveyance system according to claim 8, wherein the conductive molten metal conveyance apparatuses are arranged so that a distal end side of each of the troughs is raised more than a base end side.

11. The conductive molten metal conveyance system according to claim 8, wherein an arbitrary number of the plurality of conductive molten metal conveyance apparatuses is arranged so that each of the troughs is horizontal, and the remaining ones are arranged so that a distal end side of each of the troughs is raised more than a base end side.

12. A conductive molten metal conveyance method that drives a target conductive molten metal that is a drive target by Lorentz force, the method comprising:

preparing a trough that has at least a molten metal storage space defined by a pair of side walls laterally facing each other at a predetermined distance and a bottom connecting the side walls, and is formed by a fire resistant and conductive material;

arranging a magnetic field device below the bottom. wall of the trough, the magnetic field device having an upper surface side that vertically opposes the bottom wall and is magnetized to a north pole or a south pole, in which magnetic force lines exiting from the magnetic field device or entering the magnetic field device run vertically in the molten metal storage space and the target conductive molten metal stored in the molten metal storage space in a state of penetrating the bottom wall; and by setting an electric resistance value of the trough to a value larger than an electric resistance value of the target conductive molten metal stored in the molten metal storage space, in a non-driving state where the target conductive molten metal is not present in the molten metal storage space, causing a current to flow along a first current path from one side wall of the pair of side walls to another side wall through the bottom wall, and in a driving state where the target conductive molten metal is present in the molten. metal storage space, causing a current to flow through a second current path from the one side wall through a middle part of the first current path and bypass for the target conductive molten metal, and thereafter return to the first current path again, and in the driving state, in the target conductive molten metal, causing the magnetic force lines running vertically and the current running horizontally to cross each other to generate a Lorentz force, and by the Lorentz force, driving and carrying the target conductive molten metal in the trough.

* * * * *